US009238908B1

(12) United States Patent
DeSanto

(10) Patent No.: US 9,238,908 B1
(45) Date of Patent: Jan. 19, 2016

(54) CURB VENT STACK PLUNGER

(71) Applicant: Andrew A. DeSanto, Palmyra, NJ (US)

(72) Inventor: Andrew A. DeSanto, Palmyra, NJ (US)

( * ) Notice: Subject to any disclaimer, the term of this patent is extended or adjusted under 35 U.S.C. 154(b) by 0 days.

(21) Appl. No.: 14/323,580

(22) Filed: Jul. 3, 2014

(51) Int. Cl.

| | |
|---|---|
| ***B08B 9/04*** | (2006.01) |
| ***B08B 9/043*** | (2006.01) |
| ***E03C 1/302*** | (2006.01) |
| ***E03F 9/00*** | (2006.01) |

(52) U.S. Cl.
CPC . *E03F 9/002* (2013.01); *B08B 9/04* (2013.01); *B08B 9/0436* (2013.01); *E03C 1/302* (2013.01)

(58) Field of Classification Search
CPC ..... B08B 9/04; B08B 9/043; E03C 1/302; E03F 9/00
See application file for complete search history.

(56) References Cited

U.S. PATENT DOCUMENTS

| | | | | | |
|---|---|---|---|---|---|
| 674,197 | A | * | 5/1901 | Cooper | 4/255.01 |
| D46,996 | S | * | 2/1915 | Howell | D32/35 |
| 1,732,277 | A | * | 10/1929 | Owens | 15/104.16 |
| 2,047,182 | A | | 7/1936 | Gannon | |
| 2,272,395 | A | * | 2/1942 | Ballagh | 15/220.4 |
| 3,315,280 | A | * | 4/1967 | Krenn | 4/255.01 |
| 3,480,021 | A | * | 11/1969 | Ewald, Jr. | 134/24 |
| D290,798 | S | * | 7/1987 | Zuliani | D6/551 |
| 6,779,202 | B1 | | 8/2004 | Alldredge | |
| 2004/0163166 | A1 | * | 8/2004 | Alldredge | 4/255.01 |
| 2005/0132480 | A1 | * | 6/2005 | Walsh | 4/255.05 |

* cited by examiner

*Primary Examiner* — Randall Chin
(74) *Attorney, Agent, or Firm* — Norman E. Lehrer

(57) ABSTRACT

A curb vent stack plunger for clearing sewer drains includes an elongated pole. A first substantially circularly shaped rubberized disc is located adjacent the bottom end of the pole and lies in a first plane perpendicular to the axis of the pole. A second substantially circularly shaped rubberized disc is secured to the pole at a distance spaced upwardly from the bottom end. The second disc lies in a second plane perpendicular to the pole axis but parallel to the first disc. A soft rubberlike semi-spherically shaped bumper is secured to the remote bottom end of the pole.

4 Claims, 2 Drawing Sheets

FIG 2
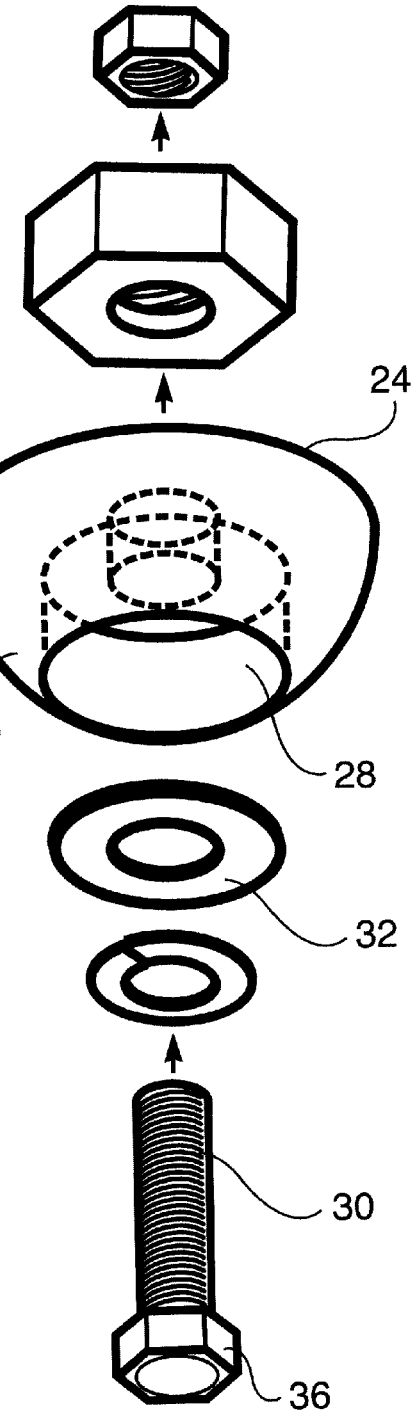
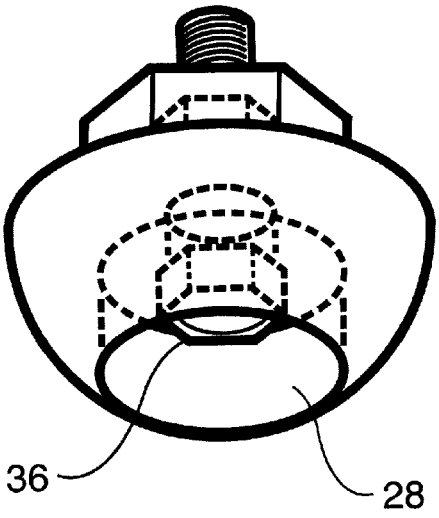
FIG 3

CURB VENT STACK PLUNGER

FIELD OF THE INVENTION

The present invention is directed toward a curb vent plunger and more particularly toward a plunger that can effectively clear a sewer vent riser located between a home or building and a main sewer and which prevents damage to the sewer frequently caused by prior devices.

BACKGROUND OF THE INVENTION

Sewerage from a house or business normally flows away from the property to a sewer main located in a street through a pipe generally referred to as a lateral. Occasionally the lateral backs up due to a blockage in the line between the house and the main. Various ways and means of freeing or clearing the blockages in the sewer lateral have been employed, but for the most part, they are attended by considerable time and expense.

One of the most common systems employed in the case of stoppage is to apply a high pressure source to the lateral by connecting a hose to a high pressure water main and extending the hose into the basement trap or into the vent pipe to flush or blow out the obstruction. If the stoppage is not too severe, this may sometimes be effective, but in the case of a more severe stoppage, the high pressure may pack or wedge the obstruction more firmly in the pipe.

Reaming or routing tools are also sometimes used. Such devices, however, are difficult to handle and operate. They are, therefore, used only by professionals which obviously increases the cost of having a sewer line cleared.

Located between the property and the main sewer line, in most cases, is a standpipe or riser. This is normally located adjacent the street curb and is commonly referred to as a curb vent. The curb vent is a vertical pipe that goes from the sewer lateral and extends upwardly to or above ground level. The curb vent allows for overflow in the event that there is a backup in the lateral between the curb vent and the house. This prevents the backup from going back into the house.

The curb vent also allows for access to the lateral. This may be necessary, for example, to clear the lateral by inserting a snake or rooter or the like either toward the house or toward the sewer main. It has also been known to insert a plunger down into the curb vent to clear a blockage. By quickly forcing the plunger down into the curb vent, the force of the moving water can frequently clear the blockage.

Known curb vent stack plungers are comprised of a long pole of an inch or so in diameter and about five or six feet long. A rubberized fabric disc having an outer diameter which is substantially the same as the inner diameter of the curb vent stack is secured to the bottom end of the pole. The disc functions as the plunger as the pole is forced downwardly into the curb vent.

While known curb vent plungers have been somewhat successful, they also suffer from a number of deficiencies. First, the outer edge of the disc can sometimes come out of contact with the wall of the curb vent stack. This can occur when the pole moves toward the wall and is not in axial alignment with the pipe, that is, when the pipe is maintained perfectly vertical. This makes the plunging action less effective and sometimes allows water and sewerage to splash upwardly and out of the top of the vent. Again, this occurs because the disc is not perpendicular to the vent stack and the compressed sewer water slips passed and up the bore usually spraying the user in the face.

Secondly, known curb plungers can damage the lateral. The disc is normally connected to the pipe with a bolt, with the head of the bolt becoming the lowermost part of the plunger. When the known curb plunger is forced downwardly, the bolt frequently strikes the bottom surface of the interior of the lateral. If enough force is applied, the lateral can break requiring costly repairs.

There is, therefore, a need for a curb vent stack plunger that is effective and that will not cause damage to the sewer lateral.

SUMMARY OF THE INVENTION

The present invention is designed to overcome the deficiencies of the prior art discussed above. Accordingly, it is an object of the invention to provide a curb vent stack plunger that will effectively clear a curb vent.

It is a further object of the present invention to provide a curb vent stack plunger that will effectively clear a curb vent and that will not damage the sewer lateral.

It is a still further object of the present invention to provide a curb vent stack plunger that will prevent water and sewerage from splashing upwardly out of the top of the vent stack contacting the user in the face and lessening the effectiveness of the compressing ability of the tool.

In accordance with the illustrative embodiments demonstrating features and advantages of the present invention, there is provided a curb vent stack plunger for clearing sewer drains. The plunger includes an elongated pole. A first substantially circularly shaped rubberized disc is located adjacent the bottom end of the pole and lies in a first plane perpendicular to the axis of the pole. A second substantially circularly shaped rubberized disc is secured to the pole at a distance spaced upwardly from the bottom end. The second disc lies in a second plane perpendicular to the pole axis but parallel to the first disc. A soft rubberlike semi-spherically shaped bumper is secured to the remote bottom end of the pole.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIG. 2 is an exploded view of the lowermost portion thereof, and

FIG. 3 is a view similar to FIG. 2 showing the parts thereof in their assembled form.

DETAILED DESCRIPTION OF THE PREFERRED EMBODIMENT

Figure 1:
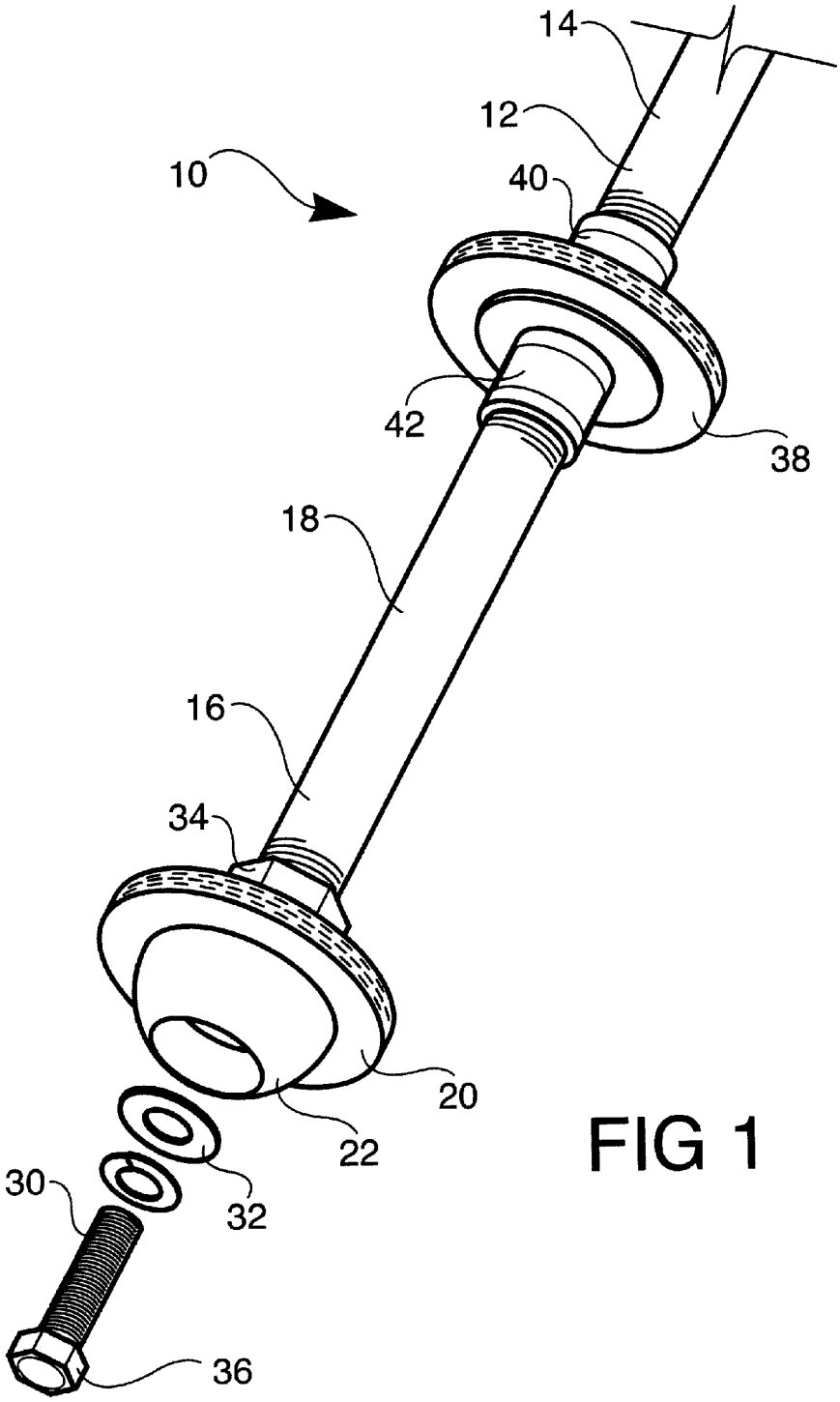
FIG. 1 is a front elevational exploded partially exploded view of the curb vent stack plunger of the present invention.

Referring now to the drawings in detail wherein like reference numerals have been used throughout the various figures to designate like elements, there is shown in FIG. 1 a curb vent stack plunger constructed in accordance with the principles of the present invention and designated generally as 10. The curb vent plunger 10 is comprised of an elongated pole 12 having a top end 14 and a bottom end 16 and which defines a vertical axis. The pole 12 is preferably 5 to 7 or 8 feet long and may be comprised of a single continuous pole or may be a number of sections connected together through any known means.

In FIG. 1, for example, the lower portion 18 of the pole 12 is comprised of an 8 to 10-inch pipe that is attached to the remaining portions of the pole 12. Preferably the entire pole 12 is made of galvanized steel although substantially any other strong material may also be usable such as black iron or the like.

A first substantially circularly shaped rubberized disc 20 is located adjacent the bottom end 16 of the pole 12 and is secured thereto through any known means. The rubberized disc 20 is preferably made of rubberized fabric material and may be made of a single layer or multiple layers of material that may be heat bonded together.

Secured to the extreme or remote bottom end of the pole section 18 is a semi spherically shaped rubber bumper 22. As shown in FIG. 2, the bumper 22 has a flat upper surface 24 and a rounded lower surface 26. A recess 28 is formed in the rounded lower surface 26. A bolt 30 carrying a washer 32 secures the bumper 22 along with the lower disc 20 to the lower end of the pole section 18 through a brass or cast steel fitting 34 that is secured to the pole section 18.

As shown most clearly in FIG. 3, when the bolt 30 is secured in place, the head 36 thereof, along with the washer 32, is recessed into the recess or opening 28. As a result of this arrangement, the head 36 of the bolt does not extend all the way to the bottom of the plunger 10. Instead, the lowermost part of the plunger 10 is comprised of the rubber bumper 22.

A second substantially circularly shaped rubberized disc 38 is secured to the pipe 12 at a distance spaced upwardly from the bottom end 16 of the pipe 12. The second disc 38 may be constructed in essentially the same manner as the first disc 20. The disc 38 is secured to the pipe 12 through well-known pipe couplings or other means 40 and 42 along with appropriate washers.

The discs 20 and 38 may be constructed of substantially the same material or may be different material. In both cases, however, they are mounted so as to lie in planes that are parallel to each other but perpendicular to the axis of the pipe 12. In the preferred embodiment, the discs 20 and 38 are spaced so as to be approximately 8 to 12 inches from each other. This is, however, by way of example only as other spacing may also be possible. Furthermore, while only two discs are shown, it should be readily apparent that three or more discs may also be employed.

The plunger 10 of the present invention is used in essentially the same manner as conventional curb vent stack plungers. That is, the lowermost disc 20 is inserted into the stack and moved downwardly while the pipe 12 is maintained in a vertical position so as to be concentric with the vent stack. The second disc 38 helps to maintain the co-axial alignment. Furthermore, the second disc 38 also prevents the splashing of water and other sewerage upwardly through the stack. Even further, because the lowermost end of the plunger 10 includes the rubber bumper 22, the lateral lying in the ground and to which the vent stack is connected will never be struck by the bottom of the pipe 12 or the bolt 30. Rather, the rubber bumper 22 protects the lateral from damage.

The present invention may be embodied in other specific forms without departing from the spirit or essential attributes thereof. For example, it is not beyond the scope of the invention to make all of the parts separately and join them together temporarily or permanently in any know manner or to make several parts together as a single piece. The discs, for example, could be molded directly onto the pipe 12. Accordingly, reference should be made to the appended claims rather than to the foregoing specification as indicating the scope of the invention.

I claim:

1. A curb vent stack plunger comprising:

an elongated straight rigid metal pole of at least five feet in length having a top end and a bottom end and defining an axis;

a first substantially circularly shaped disc of rubberized fabric material located adjacent said bottom end of said pole and secured thereto, said first disc lying in a first plane perpendicular to said axis;

a second substantially circularly shaped disc of rubberized fabric material secured to said pole at a distance spaced upwardly from said bottom end, said second disc lying in a second plane perpendicular to said axis but parallel to said first plane of said first disc, said first disc and said second disc being separately mounted on said pole and being spaced apart by at least eight inches;

each of said discs having an upper surface and a lower surface, and a soft rubberlike bumper secured to said bottom end of said pole, said bumper being semi-spherically shaped having a flat upper surface and a rounded lower surface, said flat surface being parallel to said lower surface of said first disc and said rounded lower surface being the lowermost part of the plunger.

2. The curb vent stack plunger as claimed in claim 1 wherein said flat surface of said bumper directly contacts said lower surface of said first disc.

3. The curb vent stack plunger as claimed in claim 1 wherein said bumper is made from a material that is different from said discs.

4. The curb vent stack plunger as claimed in claim 1 wherein said bumper and said first disc are separate components separately secured to said pole.

* * * * *